US008134516B1

(12) United States Patent
Yaghjian et al.

(10) Patent No.: US 8,134,516 B1
(45) Date of Patent: Mar. 13, 2012

(54) ELECTRICALLY SMALL SUPERGAIN ENDFIRE ARRAY ANTENNA

(75) Inventors: Arthur D. Yaghjian, Concord, MA (US); Teresa H. O'Donnell, Billerica, MA (US); Edward E. Altshuler, Newton, MA (US); Steven R. Best, Townsend, MA (US)

(73) Assignee: The United States of America as represented by the Secretary of the Air Force, Washington, DC (US)

( * ) Notice: Subject to any disclaimer, the term of this patent is extended or adjusted under 35 U.S.C. 154(b) by 213 days.

(21) Appl. No.: 11/973,982

(22) Filed: Oct. 1, 2007

Related U.S. Application Data

(60) Provisional application No. 60/936,016, filed on Jun. 8, 2007.

(51) Int. Cl.
*H01Q 19/10* (2006.01)

(52) U.S. Cl. ..... 343/834; 343/844

(58) Field of Classification Search ..... 343/838, 343/834, 833, 702
See application file for complete search history.

(56) References Cited

U.S. PATENT DOCUMENTS

| | | | | |
|---|---|---|---|---|
| 5,347,287 | A | 9/1994 | Speciale | |
| 5,600,242 | A | 2/1997 | Hubbell | |
| 5,844,407 | A | 12/1998 | Hubbell | |
| 5,933,001 | A | 8/1999 | Hubbell | |
| 5,994,891 | A | 11/1999 | Hubbell | |
| 6,005,380 | A | 12/1999 | Hubbell | |
| 6,154,180 | A * | 11/2000 | Padrick | 343/722 |
| 7,453,413 | B2 * | 11/2008 | Larry et al. | 343/834 |
| 2005/0174297 | A1 * | 8/2005 | Cake | 343/834 |
| 2006/0145694 | A1 | 7/2006 | Oppenlander et al. | |
| 2006/0170599 | A1 * | 8/2006 | Gilmore et al. | 343/702 |

OTHER PUBLICATIONS

H.A. Wheeler, "The Radiansphere Around a Small Antenna", *Proceedings of the IRE*, 1959, pp. 1325-1331.
N. Yaru, "A Note on Super-Gain Antenna Arrays", *Proceedings of the IRE*, 1951, pp. 1081-1085.
S.R. Best, "On the Performance Properties of the Koch Fractal and Other Bent Wire Monopoles", *IEEE Transactions on Antennas and Propagation*, Jun. 2003, pp. 1292-1300, vol. 51, No. 6.
S. Lim et al., "Electrically Small Antenna for Maximising Transmission into HF Ground Waves", *Electronics Letters*, Oct. 28, 2004, vol. 40, No. 22.
E.H. Newman et al., "A Wide-Band Electrically Small Sueprdirective Array", *IEEE Transactions on Antennas and Propagation*, Nov. 1982, pp. 1172-1176, vol. AP-30, No. 6.
S.R. Best, "The Performance Properties of Electrically Small Resonant Multiple-Arm Folded Wire Antennas" *IEEE Antennas and Propagation Magazine*, Aug. 2005, pp. 13-27, vol. 47, No. 4.
H.A. Wheeler, "Fundamental Limitations of Small Antennas", *Proceedings of the IRE*, 1947, pp. 1479-1484.

* cited by examiner

*Primary Examiner* — Jacob Y Choi
*Assistant Examiner* — Kyana R McCain
(74) *Attorney, Agent, or Firm* — AFMCLO/JAZ; Charles Figer

(57) ABSTRACT

An electrically small supergain endfire transmitting and receiving array antenna comprising at least one first resonant element with a first input terminal. The first resonant element driven by a power supply voltage supplied at the first input terminal. The electrically small supergain endfire transmitting and receiving array antenna further includes at least one second resonant parasitic element with a second input terminal. The second input terminal shorted and the second resonant element spaced less than about 0.25λ from the first resonant element at any corresponding point. The antenna has a gain of at least 6 db and ka<1.0.

1 Claim, 4 Drawing Sheets

ELECTRICALLY SMALL SUPERGAIN ENDFIRE ARRAY ANTENNA

This application claims priority from the USPTO provisional patent application entitled "Electrically Small Supergain Endfire Array Antenna" filed on Jun. 8, 2007, Ser. No. 60/936,016 which is hereby incorporated by reference.

RIGHTS OF THE GOVERNMENT

The invention described herein may be manufactured and used by or for the Government of the United States for all governmental purposes without the payment of any royalty.

BACKGROUND OF THE INVENTION

The invention relates to electrically small supergain endfire transmitting and receiving resonant antenna arrays with near optimal endfire gains of at least about 7 dB. The difficulties of narrow tolerances, large mismatches, low radiation efficiencies, and reduced scattering of electrically small parasitic elements are overcome by using electrically small resonant antennas as the elements in both separately driven and singly driven (parasitic) two-element (or more) electrically small supergain endfire arrays. Although rapidly increasing narrow tolerances prevent the practical realization of the maximum theoretically possible endfire gain of electrically small arrays with many elements, the theory, numerical simulations, and measurements indicate that near maximum supergains are achievable for electrically small arrays with two and possibly more resonant elements where the decreasing bandwidth with increasing number of elements can be tolerated.

In his 1947 paper on the fundamental limitations of small antennas, Wheeler (H. A. Wheeler, "Fundamental limitations of small antennas," Proc. IRE, vol. 35, pp. 1479-1484, December 1947) defined a small antenna as "one whose maximum dimension is less than the 'radian-length' [$\lambda/(2\pi)$]," where $\lambda$ is the free-space wavelength. All references in the present specification are herein incorporated by reference.

If one takes a radius a of a sphere that circumscribes an antenna as its "maximum dimension" measured from its center, then an antenna is electrically small if $ka<1.0$, where $k=2\pi/\lambda$ and denotes the free-space wave number. Wheeler defined a small antenna as one with $ka\leqq 1.0$. S. R. Best in "On the performance properties of the Koch fractal and other bent wire monopoles," IEEE Trans. Antennas Propagat., vol. 51, pp. 1292-1300, June 2003 (Best) suggests the definition of a small antenna as $ka<0.5$ based on how small a number of different open-ended, bent-wire antennas have to become for their radiation resistances to be approximately equal.

Here the less stringent criterion if $ka<1.0$ is used as the definition of an electrically small antenna because we are applying this criterion to array antennas with two or more elements. Since Wheeler's 1947 paper, a myriad of different electrically small antennas have been designed for a variety of applications. None of these electrically small antennas have measured gains appreciably greater than the $10\log_{10}(1.5)$ (about 1.76 dB) directivity of an elementary electric or magnetic dipole.

A gain of $N^2$ is theoretically possible for a collinear array of N isotropics radiators. This represents a remarkable "supergain" compared to the maximum possible gain, N, for isotropic radiators spaced a half wavelength apart. This supergain is attained as the length of the collinear array approaches zero. It may not be feasible to obtain close to this $N^2$ maximum endfire directivity in practice for a large number of elements because the required accuracy in the values of the magnitude and phase of the excitation currents increases very rapidly with the number of array elements N (See N. Yaru, "A note on super-gain antenna arrays," Proc. IRE, vol 39, pp. 1081-1085, September 1951).

Closely spaced, two-element, half-wavelength dipole Yagi antennas with measured gains as high as 6 to 7 dB are commercially available and two half-wavelength dipoles with equal but opposite currents and spaced about $\lambda/8$ or less achieve a gain of about 6 dB. Closely spaced, three-element, meander-line "Yagi-Uda arrays" with about 7.5 dB gain have been designed recently (though not constructed) with element heights of about a quarter wavelength. Closely spaced, three-element, half-wavelength "folded Yagi arrays" with about 7 dB gain have been recently designed and measured. Also, closely spaced, single-feed, three-element patch antennas approximately one wavelength across have been designed that have a few dB of gain at GHz frequencies. We emphasis however that none of these antennas are electrically small because the electrical size (ka) is greater than one. This level of performance has not been achieved for electrically small antennas.

In contrast to these examples of supergain endfire array antennas consisting of two, three, and four closely spaced $\lambda/2$ resonant elements, electrically small ($ka<1$) endfire transmitting antennas with supergains reasonably close to the theoretical maximum (6-7 dB for two element arrays) have eluded practical realization.

SUMMARY OF THE INVENTION

An electrically small supergain endfire transmitting and receiving array antenna, the antenna having at least one first resonant element with a first input terminal. The first resonant element driven by a power supply voltage supplied at the first input terminal. The antenna also having at least one second resonant parasitic element with a second input terminal. The second input terminal is preferably shorted and spaced less than about $0.25\lambda$ from the first resonant element at any corresponding point. The antenna has a gain of at least 6 db and $ka<1.0$.

DETAILED DESCRIPTION

Figure 1:
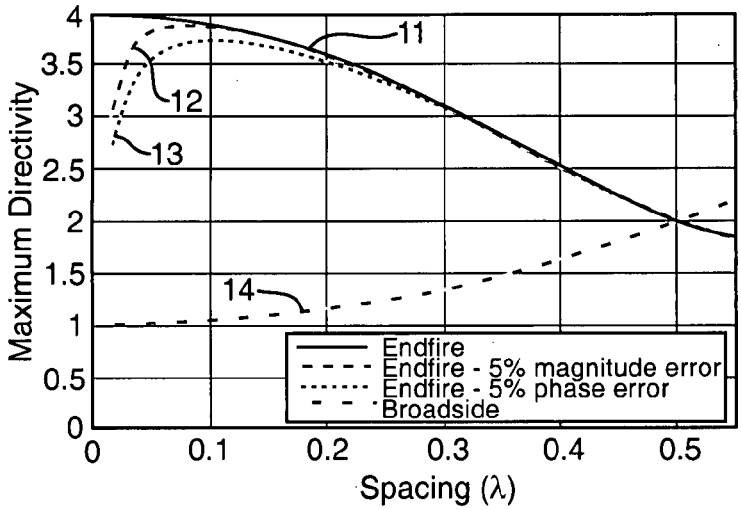
FIG. 1 graphs the change in maximum directivity versus separation distance of a two-element array of isotropic radiators caused by magnitude and phase errors in the excitation of the first element.

The present invention enables the practical realization of electrically small supergain endfire arrays through the use of resonant antennas for the array elements. By definition, resonant antennas whether or not they are electrically small, have zero input reactance at their resonant frequencies. Thus, as two nearly identical electrically small resonant antennas are brought closer together within a small fraction of a wavelength to produce supergain, their input reactances are smaller in magnitude than the input reactances of below-resonance electrically small electric-dipole antennas which have high capacitive reactances. These lower input reactances allow the array elements to be fed without the use of large tuning reactances that can add to the size and loss of the array antenna.

A lower radiation resistance implies a lower radiation efficiency, which reduces the gain proportionately, and requires a more sophisticated matching network to feed the array. However, electrically small resonant elements may be designed with multiple arms that increase both the radiation resistance and efficiency.

Possibly the most striking advantage of using resonant elements comes from the discovery that a resonant electrically small element with its input terminals shorted behaves as an effective passive director or reflector (unlike a below-resonance electrically small shorted element). An electrically small two-element supergain array with one element fed and one shorted parasitic element exhibits a supergain within a few tenths of a dB of the maximum possible supergain of the corresponding doubly fed two-element array. Moreover, this result appears to hold generally for all resonant antenna elements, and thus opens the possibility of a variety of single-feed, electrically small, parasitic supergain arrays.

Five stated or assumed reasons for the lack of progress in the development of electrically small supergain arrays can be summarized as follows. One, the required tolerances on the magnitude and phase of the element input excitations are too tight to be maintained in practice. Two, closely spaced electrically small elements have such high input reactances and such low radiation resistances that mismatch losses between the power supply and the antenna elements would prevent the practical realization of supergain. Three, even if the mismatch losses can be overcome with a well designed matching network, the ohmic losses in the electrically small elements and the matching network would dominate the low radiation resistance of the array antenna and eliminate any substantial supergain. In other words, the radiation efficiency of an electrically small array would be too low to allow for supergain. Four, parasitic endfire arrays, the Yagi being the prime example, are attractive because they have just one fed element. Yet, they are unsuitable for electrically small supergain endfire arrays since electrically small parasitic elements, unlike half-wavelength parasitic elements, would not make effective enough scatterers (reflectors or directors) to produce supergain. Five, the bandwidth of many electrically small supergain arrays would be too narrow for many applications.

The required magnitude and phase tolerances of the element excitations for closely spaced electrically small supergain endfire arrays may be comparable to those for supergain endfire arrays with similarly spaced half-wavelength electric dipole elements. Our expectation based upon analysis and testing was that the tolerances for electrically small supergain arrays with just a few elements would not be prohibitive, and this expectation proved correct.

As part of the present error analyses, the maximum endfire directivities versus element spacing with either a 5% magnitude error or a 5 degree phase error in the excitation coefficient of the first element of a two-element and three-element endfire array were computed.

FIG. 1 is a graph of the change in maximum directivity versus separation distance of a two-element array of isotropic radiators caused by magnitude and phase errors in the excitation of the first (one) element. The FIG. 1 graph includes an endfire data plot 11, an endfire data plot with a 5% magnitude error 12, an endfire with a 5% phase error 13, and a broadside data plot 14.

Figure 2:
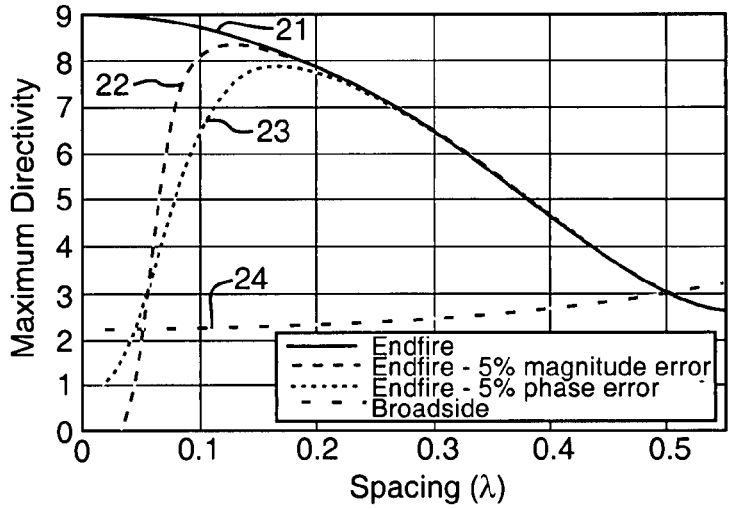
FIG. 2 graphs the change in maximum directivity versus separation distance of a three-element array of equally spaced isotropic radiators caused by magnitude and phase errors in the excitation of the first element.

FIG. 2 is a graph of the change in maximum directivity versus separation distance of a three-element array of equally spaced isotropic radiators caused by magnitude and phase errors in the excitation of the first (one) element. The FIG. 2 graph includes an endfire data plot 21, an endfire data plot with a 5% magnitude error 22, an endfire with a 5% phase error 23, and a broadside data plot 24.

The results shown in FIG. 1 and FIG. 2 are for electrically small isotropic radiators. The results tend to indicate that magnitude and phase errors do not decrease the maximum endfire directivity $N^2$ by more than about 10% for two- and three-element arrays if the spacing of the array elements is larger than about $0.05\lambda$ for two-element array of FIG. 1 and $0.15\lambda$ for the three-element array of FIG. 2, respectively. Moreover, at separation distances of about $0.05\lambda$ and $0.15\lambda$, these two- and three-element arrays of isotropic radiators have directivities close to their maximum possible values of $N^2=4$ and 9, respectively. The computed maximum broadside directivities of these arrays are also shown in FIG. 1 and FIG. 2 for the sake of comparison with the endfire directivities. Electrically small broadside arrays of N equally spaced isotropic radiators were found to produce a gain no greater than N.

Therefore, although tolerance constraints prevent the practical realization of significant supergain for endfire arrays with more than a few elements, calculations show that the maximum possible endfire gains of arrays with two, three, and possibly more elements can be approached without encountering prohibitive tolerance constraints. Also, for endfire supergain arrays where beam steering is not required, the strong mutual coupling between the closely spaced elements does not have to be reduced in order to properly drive the elements, as may be the case for broadside steered-beam super directive arrays.

An electrically small time-harmonic ($e^{jwt}$ where $w=2\pi f>0$) antenna operating at a frequency f well below its first resonant or antiresonant frequency is generally either a capacitive electric dipole with a reactance that behaves as 1/f and a radiation resistance that behaves as $f^2$, or an inductive magnetic dipole with reactance that behaves as f and a radiation resistance that behaves as $f^4$. Note that by definition, an antenna operates at a resonant or antiresonant frequency f if its input reactance X(f) is zero and dX(f)/df>0 or dX(f)/df<0, respectively. This extremely low radiation resistance of a magnetic-dipole antenna operating well below its first resonance makes it unsuitable for use as an element in an efficient antenna array, and thus we are left with only electrically small electric-dipole elements in the class of antennas that can be used in supergain arrays well below their first resonance.

High capacitive reactance of below-resonance electric-dipole elements generally requires cancellation by tuning inductive reactances in order to feed the antenna array a reasonable amount of power. For example, an electric dipole operating at one-third its resonant frequency typically may have a negative input reactance of more than 1200 ohms and a radiation resistance of about 6 ohms. Depending on the frequency, a 1200 ohm tuning inductor may add an appreciable ohmic loss to the electric-dipole element and significantly increase its size without increasing its radiation resistance.

An alternative to tuning a highly reactive, below-resonance, electrically small antenna element is to use a self-resonant antenna element having the same electrical size (a self-resonant antenna is an antenna that requires no tuning to be resonant at the frequency of interest). This alternative may yield an antenna element with negligible input reactance while keeping the ohmic losses to a minimum. In addition, electrically small resonant antennas may be designed with high radiation resistances and efficiencies, at least at and below GHz frequencies. The radiation resistance of an electrically short, straight-wire, electric dipole antenna of length 2 a may have a radiation resistance given by 20 $(ka)^2$ ohms. Simulations with the Numerical Electromagnetics Code (NEC) indicate that a well-designed electrically small, open-ended (as opposed to closed-loop or folded), bent-wire resonant antenna may have a radiation resistance of 2 to 3 times this value. As two elements of the suppergain array get closer together, the phase difference between the equal magnitude currents approaches 180°. Thus, the fields produced by these currents tend to cancel and the array element radiation resistance decreases in proportion to the normalized power as shown in FIG. 3.

NEC is a readily available method of moments computer program written originally at Laurence Livermore National Laboratories to numerically simulate the operation of bent wire antennas.

Figure 3:
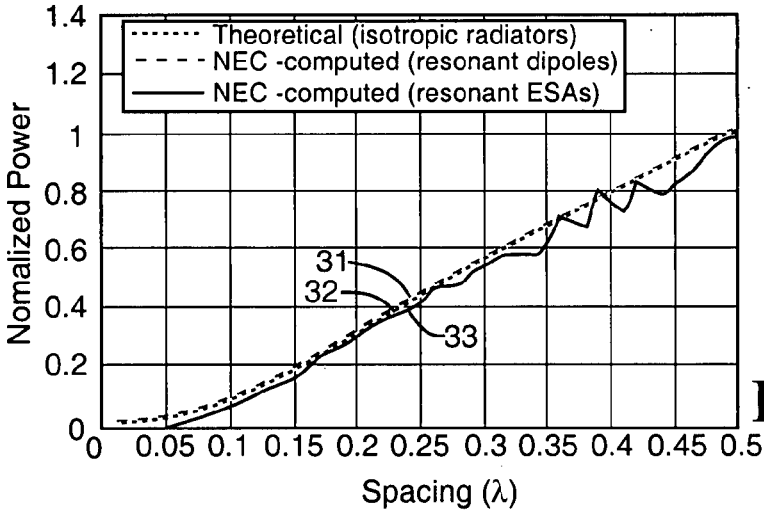
FIG. 3 graphs the normalized power for two-element superdirective arrays of isotropic radiators, resonant electric dipoles, and resonant electrically small antennas.

FIG. 3 is a graph of the free-space wavelength λ and the normalized power for a two-element super directive array of isotropic radiators 31, resonant electric dipoles 31, and resonant electric small antennas 33 as calculated by NEC.

The 5 ohm radiation resistance of a 400 MHz (a/λ=1/20, ka=0.314) resonant antenna may be reduced to about 1 ohm for two of these antennas separated by 0.15λ and the radiation efficiency of this two-element array would be reduced to about η=83%, which represents a reduction in the supergain of about 0.8 dB. An ohmic-loss reduction of about 0.8 dB or less in the 6 to 7 dB maximum endfire gain of an electrically small two-element array may not be considered a significant compromise in the supergain.

The first two-element supergain array measured to confirm that a supergain close to the maximum predicted value of 6 to 7 dB could be achieved experimentally was constructed from two electrically small (a/λ≈1/18, ka≈0.35), open-ended, bent-copper-wire antennas resonant at about 400 MHz with a free-space radiation resistance of about 6 ohms, reducing to about 1.2 ohms at a separation of 0.15λ.

It introduces additional difficulties to efficiently feed an antenna with input resistances of a few ohms or less. Fortunately, for electrically small, open-ended, bent-wire resonant antennas, the radiation resistance can be greatly increased simply by adding a small tuning loop (or post) across the feed point in parallel with the original antenna. A small tuning loop provides the main conduction path for the resonant current and thus lowers the feed-point current for a given applied voltage, thereby increasing the input resistance. It does not, however, significantly change the radiation efficiency or bandwidth because the stored energy and power radiated is still determined predominantly by the resonant current on the original bent-wire antenna. Thus, tuning loops may alleviate the problem of matching to a very low radiation resistance. However, they do not increase the radiation efficiency of electrically small, open-ended, bent-wire resonant antennas.

Electrically small, low-loss, wire-loop antennas operating at their first antiresonant frequency have radiation resistances too high (usually many thousands of ohms) to feed without sophisticated circuitry that would increase the size and lower the efficiency of such antennas. A wire-loop antenna may be excited at a frequency slightly above or below the antiresonant frequency, then retuned to zero reactance with an inductor or capacitor to obtain a much lower input resistance (50 ohms, for example).

A similar technique may be used to match the impedance of slot antennas. Unfortunately, this matching technique does not also increase the radiation efficiency and it decreases the bandwidth of the wire-loop antenna.

An approach that may increase both the radiation resistance and efficiency of resonant antennas, including electrically small resonant antennas, is to use multiple folded arms. The half-wavelength, straight-wire, folded dipole is the classic example of such a resonant antenna (although it is not electrically small)', but any number of bent-wire folded resonant antenna designs display the same attractive features of a higher radiation resistance combined with a higher radiation efficiency and often a greater bandwidth (lower Q). An electrically small, bent-wire, folded resonant antenna with M arms (including the feed arm) is essentially a loop antenna with M−1 bent wires connecting the top and bottom of the bent-wire arm that is fed.

With a symmetric design, all of the M arms carry approximately the same resonant current as the feed arm and thus, the total power radiated by the antenna scales approximately as $M^2$. The antenna's ohmic loss resistance, however, scales approximately only as the number of arms M and thus the efficiency (η) of the antenna increases with M as $$\eta = \frac{M^2}{M^2 + \alpha M} = \frac{1}{1 + \alpha / M}$$

which approaches unity as M gets large (until the number of arms and bends start to interfere with one another). The constant α, which is proportional to the resistivity of the wire material, can be expressed in terms of the efficiency $\eta_1$ of the original one-arm (M=1) bent-wire antenna by the formula $\alpha = 1/\eta_1 - 1$.

Many combinations of bends, folds, and tuning posts may be used in the NEC to design efficient, electrically small, bent-wire, resonant antennas with appreciable radiation resistances and reasonably low values for quality factors Q. These resonant antennas may then be used as the elements in electrically small, separately fed and singly fed (parasitic), two-element, supergain endfire arrays.

In one test program the maximum endfire directivity versus separation distance of two parallel, separately driven, nominally half-wavelength, 1.6 mm diameter, lossless, straight-wire dipoles was considered.

Figure 4:
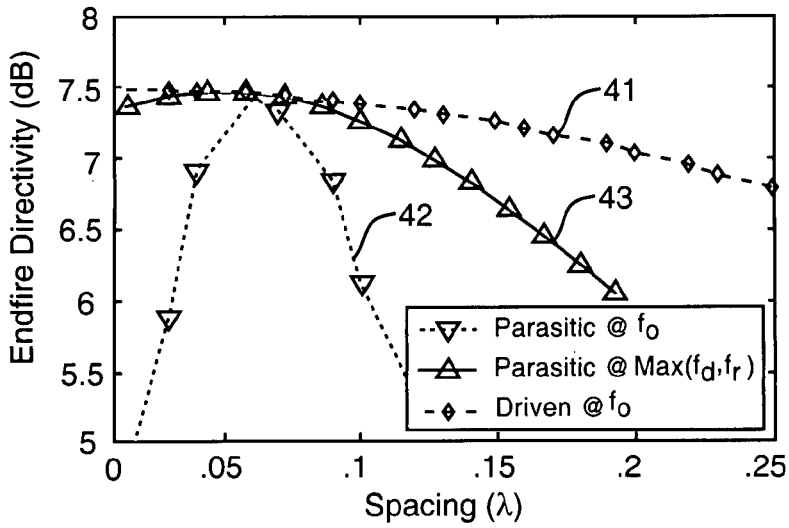
FIG. 4 graphs endfire directivity versus separation distance of two nominally half-wavelength, lossless, straight-wire dipoles for three cases.

FIG. 4 graphs endfire directivity versus separation distance of two nominally half-wavelength, lossless, straight-wire dipoles for three cases. Curve 41 has both elements optimally driven to obtain maximum directivities at the individual-element resonant frequency $f_0$=437 MHz. Curve 42 has one element shorted and the other element driven at the resonant frequency $f_0$. Curve 43 has one element shorted and the other driven at shifted frequencies $f_d$ and $f_r$ that produce maximum directivities in the endfire directions for which the parasitic element is a director or a reflector.

In free space each resonant dipole in FIG. 4 has an input (radiation) resistance of 72 ohms and a Q of 5.6. Each of the dipoles for Curve 41 is fed with the same current magnitude and with the phase difference determined with the NEC that produces the maximum directivity at each separation distance. As the separation distance approaches zero, the maximum directivity approaches 7.5 dB, a value that is 1.5 dB higher than the maximum directivity of 6 dB ($N^2$=4) for two isotropic radiators approaching zero separation distance.

If the same two half-wavelength elements are used to form a parasitic (Yagi) antenna with one element fed at the individual resonant frequency of $f_0$=437 MHz, and the parasitic element is shorted, the directivity versus separation distance is shown by the dotted curve (Curve 42) in FIG. 4.

If the frequency of the one fed element is shifted slightly (typically not more than a few MHz) to a value $f_d$ or $f_r$ to maximize the directivity at each separation distance, depending on whether the maximum occurs with the shorted parasitic dipole acting as a director (subscript "d") or a reflector (subscript "r"), the maximum directivity versus separation distance is shown by the solid curve (Curve 43) in FIG. 4.

The direction of maximum directivity switches from the parasitic dipole acting as a reflector to the parasitic dipole acting as a director at a separation distance of about 0.12λ. Notably, the two parasitic curves (Curve 42 and Curve 43) in FIG. 4 reach a maximum directivity (which always occurs when the array is a driver-director Yagi) greater than 7.4 dB, that is, less than 0.1 dB below the highest possible theoretical maximum of 7.5 dB for the separately driven elements. Moreover, if the loss of the copper wire is taken into account in the NEC code, the maximum gain that is reached for the separately fed and parasitic two-element arrays is about 7.25 dB; that is, the difference between the maximum possible directivity and gain of the two dipoles is surprisingly about 0.25 dB.

At 0.1λ separation distance, the NEC-computed gain of a lossy two-element Yagi is calculated to be about 7.17 dB, its efficiency is calculated to be about 97.6%, its input impedance is about 13.4-29.6i ohms, and its Q is 53.8 after tuning the negative 29.6 ohm reactance to zero with a small series inductor. This value of Q corresponds to about a 3.7% matched voltage-standing-wave-ratio (VSWR) half-power fractional bandwidth.

There are at least two reasons why two closely spaced, nominally half-wavelength, straight-wire dipoles form a parasitic array (Yagi) may achieve nearly the same maximum possible gain shown in FIG. 4 as two separately (and optimally) fed closely spaced half-wavelength straight-wire dipoles. First, the shorted parasitic element forms a resonant dipole scatterer, so that for closely spaced and thus strongly coupled elements, the magnitude of the current on the parasitic element can be as large as that on the driven element. Second, the phase difference between the resonant current on the driven and parasitic elements is close to 180 degrees. In other words, the closely spaced, two-element, resonant Yagi is operating predominantly in the odd mode of two coupled resonators.

Since the directivity of two closely spaced antennas is maximized if the magnitudes of the currents on each element are equal and the phase difference between the currents is close to 180 degrees, it follows that on either side of the resonant frequency at which nearly equal magnitude currents are nearly 180 degrees out of phase, approximately the maximum possible directivity is attained.

In view of these foregoing two reasons why two-element parasitic arrays of closely spaced, nominally half-wavelength, straight-wire, resonant dipoles may attain such a high directivity, it becomes more evident that shortening the wires to make them electrically small may eliminate the possibility of high directivity. There appears to be no inherent limitation as to why two electrically small resonant antennas may not be used as elements in an electrically small two-element supergain array in which one resonant antenna was driven and the other resonant antenna was shorted to form a resonant scatterer. Indeed, NEC-computed simulations with numerous two-element parasitic arrays of electrically small resonant antennas verified this conjecture.

Figure 5:
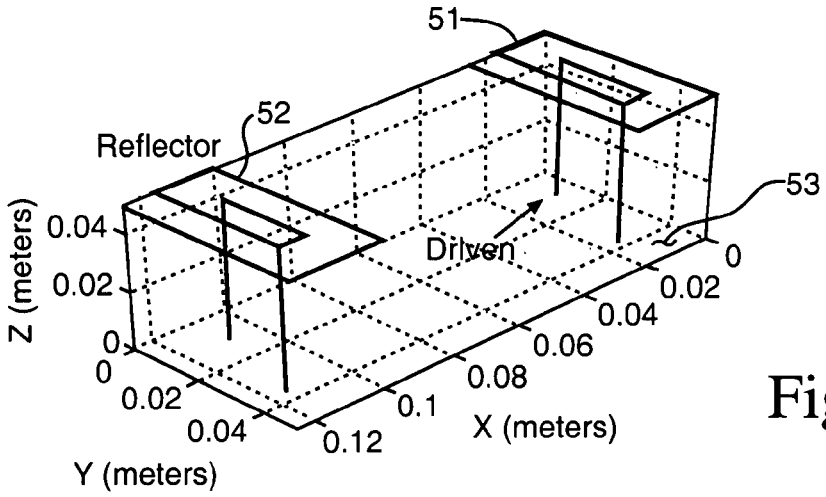
FIG. 5 is an illustration of two electrically small top loaded, folded, 1.6 mm diameter and wire antennas individually resonant at $f_0$ about equal to 437 MHz, forming a two-element parasitic array.

As an example, FIG. 5 shows two identical electrically small (ka=0.5 in free space), top-loaded, folded, 1.6 mm diameter bent-wire antennas. A driven antenna 51 and a shorted antenna 52, both are individually resonant at $f_0$=437 MHz to form a two-element parasitic array (a parasitic array has one element driven and the other shorted). FIG. 5 shows the array over an infinite perfectly electrically conducting (PEC) ground plane 53. In free-space, the array would include the mirror image of the elements extending in the negative z direction. Each of the resonant antennas 51 and 52 alone over ground has a radiation resistance of about 61 ohms and a Q of about 38. In free-space the corresponding resonant antennas have a radiation resistance of about 122 ohms and the same Q of about 38.

Driven antenna 51 and shorted antenna 52 are as identical as possible with corresponding points on each being an equal distance from each other such that every point on one antenna is the same linear distance from the corresponding point on the other antenna.

To achieve practical electrically small supergain arrays, the driven antenna elements preferably have high radiation efficiencies (greater than 90%) and input impedances matched to the feed lines attaching the voltage sources to the input terminals of the antenna elements. To reduce the input reactance (the imaginary part of the input impedance) to a feasibly low value, only resonant antenna elements were used. To obtain reasonably high radiation resistances (real part of the input impedance) on the order of 50 ohms as well as high radiation efficiencies, top loading and folded arms were incorporated into the design of the electrically small resonant antenna elements.

The theory behind the use of folded arms in electrically small resonant antenna elements relies on the total power radiated by an antenna element with M arms scaling approximately as $M^2$, whereas the antenna's ohmic loss scales approximately as M. Thus, the efficiency of the antenna increases with M as $$\eta=100(1+\alpha/M)^{-1}\%$$

which can be close to 100% even for just two arms (M=2).

Figure 6:
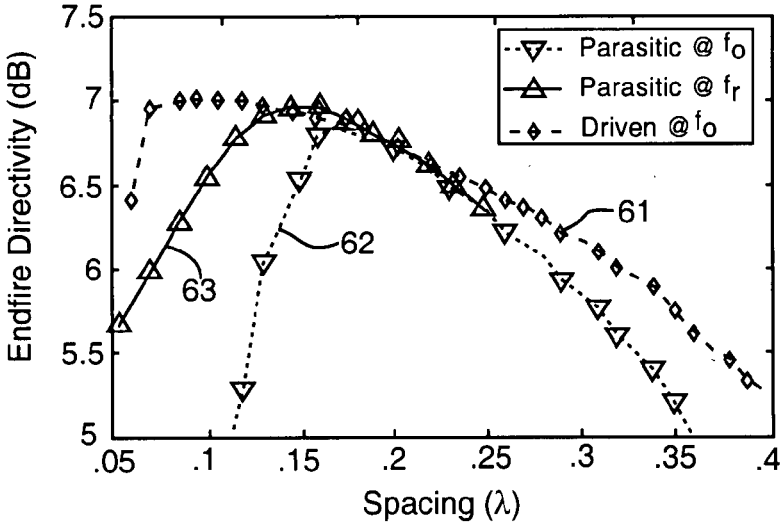
FIG. 6 graphs the endfire directivity versus separation distance for the electrically small two-element array shown in FIG. 5.

The NEC-computed endfire directivity versus separation distance of the two-element parasitic array in FIG. 5 is plotted in FIG. 6, where 3 dB has been subtracted to give the free-space directivity of the elements in the absence of the ground plane. As in FIG. 4 for the half-wavelength dipoles, three curves are shown in FIG. 6. Curve 61 has both elements optimally driven to obtain maximum directivities at the individual-element resonant frequency $f_0$. Curve 62 has the parasitic directivities at the individual resonant frequency $f_0$=437 with one element shorted and the other element driven. Curve 63 has the parasitic directivities maximized at each separation distance by shifting the frequency to a value $f_r$. Unlike the two-element half-wavelength dipole array, the maximum directivity at all separation distances of this two-element electrically small parasitic array occurs in the endfire direction for which the parasitic element is a reflector rather than a director.

The curves in FIG. 6 reveal the remarkable result that at a separation distance, of about 0.15λ, the parasitic array curve 63 reaches a maximum directivity that is less than 0.1 dB below the maximum possible separately driven directivity of 7.0 dB. With loss in the copper wires taken into account, the NEC code predicts that the maximum gain drops slightly to 6.5 dB. At about a 0.15λ, the efficiency of the array is about 90%, its free-space input impedance is about 50+70i ohms, and its Q≈154 (half-power matched voltage-standing-wave-ratio (VSWR) impedance fractional bandwidth of about 1.3%) after tuning out the 70 ohm reactance with a small capacitor. The array also exhibits a 1.3% fractional bandwidth with respect to a 1 dB drop in gain. The entire two-element array in free space fits into a sphere of ka≈0.7. The NEC computations for many other two-element arrays formed with various electrically small folded bent-wire antenna elements produced similar results.

In regard to the bandwidth concerns, electrically small antennas have quality factors (Qs) that are larger and usually many times larger than $0.5/(ka)^3$, and thus are narrow-band for ka<<1 unless they are fed through complex tuning circuits or are specially designed to have multiple resonances at closely spaced frequencies. Unfortunately, widening the bandwidth with complex tuning circuits and special designs for multiple resonances is generally not compatible with low loss and keeping the entire antenna system electrically small at GHz frequencies. Moreover, as two electrically small antenna elements are brought closer together than a half-wavelength, the radiation resistance decreases, the Q increases and the bandwidth decreases (typically by a factor of about five at λ/8 (or 0.125λ) spacing). The bandwidth concerns may be mitigated by working with narrow band applications. The present invention overcomes these limitations and the problems of tight tolerances, large mismatches, low radiation efficiency, and reduced scattering of electrically small parasitic elements.

Figure 7:
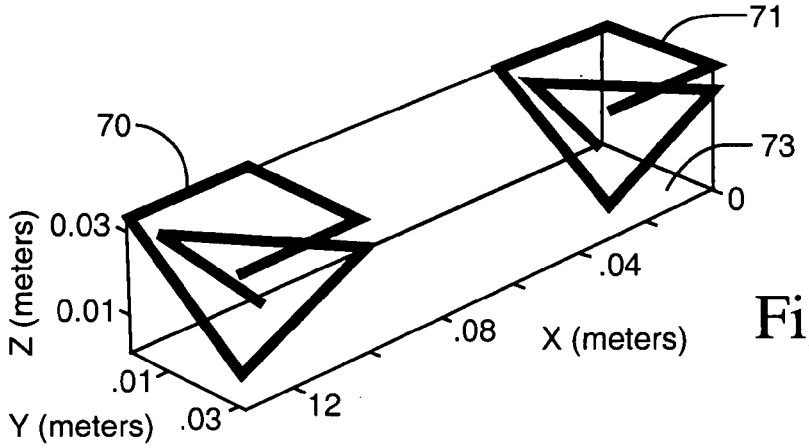
FIG. 7 illustrates a two-element supergain array over an infinite xy perfectly electrically conducting (PEC) ground plane with each element an optimally driven electrically small, seven-segment, open-ended, bent-copper-wire antenna resonant at about 400 MHz.

In FIG. 7, two identical antenna elements 70 and 71 are shown over an infinite xy PEC ground plane 73. The elements 70 and 71 are electrically small, seven-segment, open-ended, bent-copper-wire antennas that resonant at about 400 MHz. Each antenna element has a free-space value of a/λ≈1/18 (0.056), and ka≈0.35. The NEC simulations with loss in the copper wire predict that each of the free-space antennas have a radiation resistance of 5.4 ohms, an efficiency of 94%, and a Q of 95 with a half-power matched voltage-standing-wave-ratio (VSWR) fractional bandwidth of about 2%.

Figure 8:
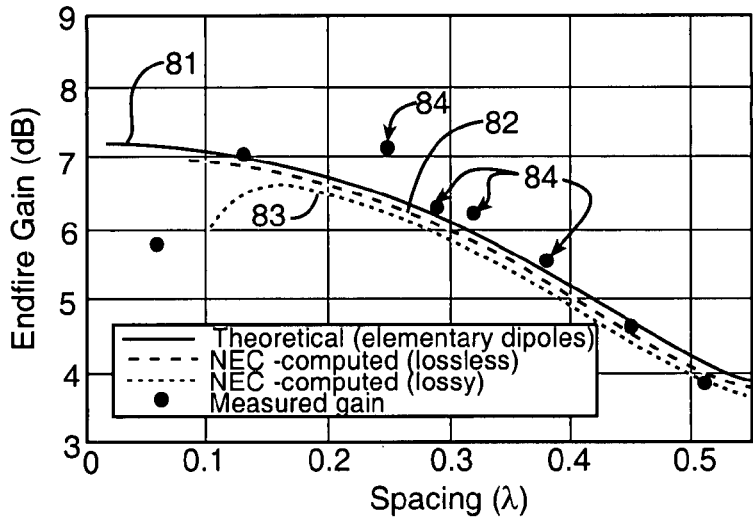
FIG. 8 graphs NEC-computed and measured maximum endfire gains as a function of separation distance of separately fed two-element arrays as shown in FIG. 7 (with 3 dB subtracted because of the ground plane), as well as the maximum theoretical gain of two separately fed elementary dipoles versus separation distance.

The NEC computations of gain as a function of separation distance for the array in FIG. 7 are shown in FIG. 8 with and without loss in the copper wire. Each of the antenna elements in FIG. 7 are driven separately at the individual-element resonant frequency and with the optimum currents, equal magnitude and a phase difference to produce the maximum endfire directivity. Curve 81 shows the theoretical elementary dipoles. Curve 82 shows the NEC computed values for a system without copper wire losses. Curve 83 shows the NEC computed values for a system with copper wire losses. Data points 84 shown in FIG. 8 are the measured values of maximum gain versus separation distance obtained over a finite ground plane with the measurement system depicted schematically in FIG. 9.

Figure 9:
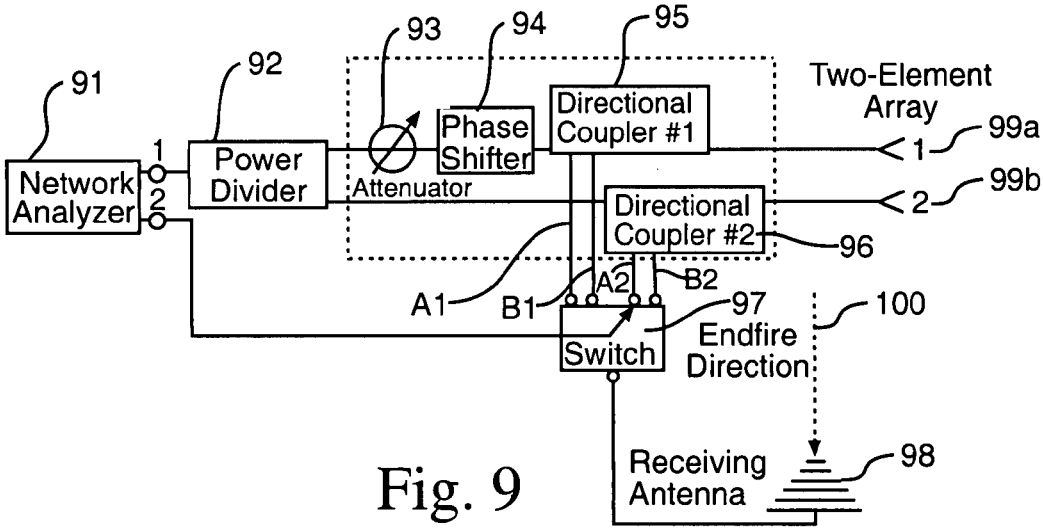
FIG. 9 is a schematic of one embodiment of a gain measurement system for two separately fed array elements.

FIG. 9 includes a network analyzer 91 operatively connected to a power driver 92 an attenuator 93, a phase shifter 94, a first directional coupler 95, and a second directional coupler 96. Each directional coupler is connected to an element of the two element array 99*a* and 99*b*. A switch 97 connects the network analyzer 91 to the outputs of the directional couplers 95 and 96 through connections A, B1 and A2, B2, respectively. The two element array 99*a*, 99*b* provides an endfire direction 100 towards a receiving antenna 98.

Although all the computations and measurements of this two-element array were made over a PEC ground plane, the values of gain in FIG. 8 have been reduced by 3 dB to those of the corresponding free-space two element array (comprised of the antennas in FIG. 7 and their images in the ground plane).

The curve in FIG. 8 of the NEC-computed data for the lossy two-element array (curve 83) of separately fed elements shows that a gain of about 6.7 dB is attained at a separation distance of about 0.15λ, where the entire free-space array fits into a sphere with electrical size of about ka=0.7. This high value of gain, which is just 0.3 dB less than the maximum possible lossless NEC-computed supergain of about 7 dB for these electrically small, open-ended, bent-wire antenna elements, is confirmed by the values of the measured gain shown in FIG. 8 as data points 84. The solid curve 81 in FIG. 8 demonstrates that the theoretically determined values of maximum endfire directivity for two optimally driven elementary dipoles are very close to the gain values computed for the two-element array of optimally driven, lossless, electrically small, bent-wire elements.

Accurate measured values of gain as shown in FIG. 8 were difficult to obtain, especially at the smaller separation distances because the initial low value of the input resistance of each of these bent-wire elements decreased with decreasing separation distance (e.g. 5.7/2=2.9 ohms over the ground plane). This produced a reflected power that was nearly as large as the incident power and thus the accepted power could not be accurately measured with the network analyzer 91 as shown in FIG. 9. Repeated measurements indicated that it is unlikely that the values of the measured gain given in FIG. 8 have error bars less than about ±1 dB for separation distances of less than about 0.25λ. Nonetheless, these early measurements strongly indicated that values of supergain of between 6 and 7 dB could indeed be obtained with separately (and optimally) driven, electrically small, two-element, bent-copper-wire arrays. We could have made additional, more accurate measurements with separately driven electrically small elements that have much higher input radiation resistances such as those shown in FIG. 5 but our discovery that parasitic (single feed), electrically small, two-element arrays exhibited practically the same supergain as with separately driven array elements led us to abandon the tedious procedure required for the gain measurement of separately driven two-element arrays.

Figure 10:
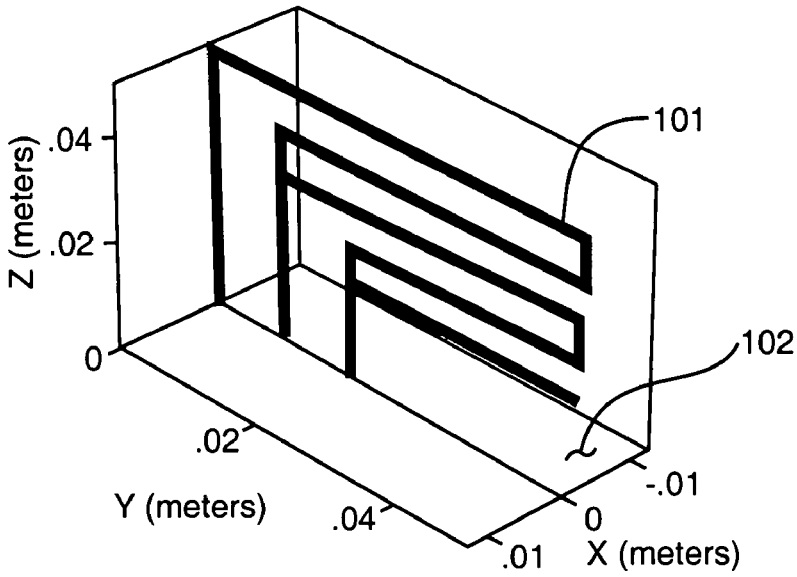
FIG. 10 is an illustration of an electrically small, planar, double folded, bent-copper-wire, two-element parasitic array antenna resonant at about 876 MHz.

FIG. 10 shows a single element planar doubly folded bent-copper-wire antenna 101 of the two-element parasitic array (not shown) over an infinite xy PEC ground plane 102. An electrically small, planar, doubly folded, bent-copper-wire antenna resonant at about 876 MHz was used to measure the two-element parasitic array of similar structure.

The two elements were oriented parallel to each other and separated along the normals to their planes. The NEC-computations and measurements were done over a ground plane with the driven element fed at (x,y,z)=(0,0,0) and the parasitic element shorted at its feed point. Each of the antennas fed alone has a resonant frequency of about 876 MHz and, along with its image in free space, each has a circumscribing sphere of electrical size ka≈1. Each antenna element has a Q of about 4.3, a radiation resistance in free space of about 284 ohms, and a radiation efficiency greater than about 99.5%. For small fractional wavelength separations, the two-element array of these planar antennas also has a ka≈1.

Although this borders on being electrically small, the high radiation resistance, high efficiency, and low Q of these planar array elements allowed for more accurate measurements. Still, the edge effects of the finite ground plane (about 4 feet by about 4 feet), on which the measurements were made, introduced error bars estimated at ±0.5 dB.

Figure 11:
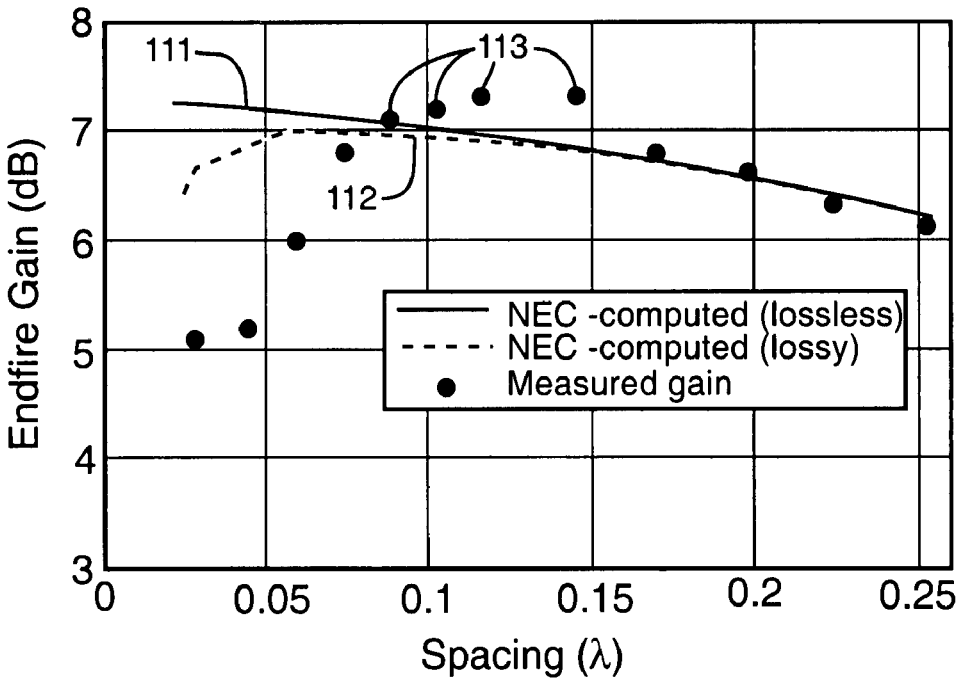
FIG. 11 is NEC-computed and measured maximum endfire gains as a function of separation distance of a parasitic two-element array formed with the antenna element shown in FIG. 10 (with 3 dB subtracted because of the ground plane).

The NEC-computed and measured endfire gains versus separation distance of this two-element parasitic array are plotted in FIG. 11. At each separation distance, the frequency was shifted to obtain the maximum endfire gain, which was always in the direction with the parasitic element acting as a reflector rather than as a director. Curve 111 shows the NEC computed values for a lossless system without copper wire losses. Curve 112 shows the NEC computed values for a lossy system with copper wire losses. Data points 113 shown in FIG. 11 are the measured values of maximum gain versus separation distance obtained.

FIG. 11 shows that the highest maximum values of the NEC-computed and measured gains of the lossy parasitic array (curve 112) in free space occur between the separation distances of 0.05λ and 0.12λ. In particular, the maximum computed (curve 111) and measured values (113) of endfire gain are both equal to about 7 dB (with 3 dB subtracted from their ground-plane values) at a spacing of 0.1λ, where the free-space electrical size of the two-element array (with its image) is ka≈1. This gain value of 7 dB is only about 0.3 dB lower than the maximum attainable value of endfire gain (7.3 dB) as computed with NEC for a two-element array of these planar antenna elements when they are lossless. At a separation distance of 0.1λ, the maximum endfire gain is obtained at a frequency of about 874 MHz, the efficiency of the array is about 98.5%, its free-space input impedance is about 61+118i ohms, and its value of Q is about 41 after tuning out the 118 ohm reactance with a small capacitor. The half-power matched VSWR impedance fractional bandwidth was about 4.8%. The array exhibits about an 8% fraction bandwidth with respect to about a 1 dB drop in gain. This 7 dB-gain array constructed from a driver-reflector pair of planar bent-copper-wire resonant antennas demonstrates the feasibility and practicality of producing many other similarly efficient, well-matched, electrically small, two-element, parasitic supergain endfire arrays.

By using resonant antennas as the elements in a two-element array, we have shown from theory, numerical simulation, and experimental measurements that the difficulties of narrow tolerances, large mismatches, low radiation efficiencies, and reduced reflector-element or director-element scattering can be overcome to enable the practical design and construction of electrically small (ka<1) supergain two-element endfire arrays with gains as high as 7 dB. This enhanced value of gain, which is just a few tenths of a dB less than the maximum theoretically possible gain of these two-element arrays, may be obtained with one resonant element driven and the other shorted to form a parasitic two-element array as well as with separately (and optimally) driven resonant elements. Although rapidly increasing narrow tolerances prevent the practical realization of the maximum theoretically possible endfire gain of electrically small arrays with many elements, the theory and preliminary numerical simulations indicate that near maximum supergains may be achievable in practice for electrically small arrays with three and four resonant elements, and possibly, though less likely, with more than four resonant elements.

The half-power matched voltage-standing-wave-ratio impedance fractional bandwidth of the electrically small supergain two-element parasitic arrays was found from the theory, computations, and measurements to be no more than a few percent. For electrically small arrays with more than two elements and greater supergains, the bandwidth may be appreciably less. Thus, the future development of electrically small supergain arrays may naturally entail research into increasing their bandwidth, possibly through the use of electrically small antenna elements with multi-resonances and the incorporation of nonlinear matching networks.

While specific embodiments have been described in detail in the foregoing description and illustrated in the drawings, those with ordinary skill in the art may appreciate that various modifications to the details provided could be developed in light of the overall teachings of the disclosure.

What is claimed is:

1. An electrically small supergain endfire transmitting and receiving array antenna comprising:

at least one first resonant element having a first input terminal and multiple folds and posts, wherein the folds and posts return to ground, the first resonant element driven by a power supply voltage supplied at the first input terminal; and at least one second resonant parasitic element with a second input terminal, the second input terminal shorted, the second resonant element spaced less than about 0.15 times a free-space wavelength (λ) from the first resonant element at any corresponding point, wherein the antenna has a gain of at least 6 dB with a radian length k equal to 2π/λ and a radius a of a sphere that circumscribes the antenna, a radiation resistance of about 50 Ohms and ka less than 1.0.

* * * * *